US005704556A

United States Patent [19]

McLaughlin

[11] Patent Number: 5,704,556

[45] Date of Patent: Jan. 6, 1998

[54] PROCESS FOR RAPID PRODUCTION OF COLLOIDAL PARTICLES

[76] Inventor: John R. McLaughlin, 240 Highview La., Media, Pa. 19063

[21] Appl. No.: 716,561

[22] Filed: Sep. 16, 1996

Related U.S. Application Data

[63] Continuation-in-part of Ser. No. 482,077, Jun. 7, 1995, abandoned.

[51] Int. Cl.[6] ..... B02C 17/00; B02C 17/20

[52] U.S. Cl. ..... 241/21; 241/26

[58] Field of Search ..... 241/21, 26, 27

[56] References Cited

U.S. PATENT DOCUMENTS

| | | | |
|---|---|---|---|
| 2,621,859 | 12/1952 | Phillips . | |
| 2,678,168 | 5/1954 | Phillips . | |
| 3,090,567 | 5/1963 | Schafer et al. . | |
| 3,405,874 | 10/1968 | Brizon . | |
| 3,677,476 | 7/1972 | Harneo . | |
| 3,816,080 | 6/1974 | Bomford et al. . | |
| 3,995,817 | 12/1976 | Brociner . | |
| 4,065,544 | 12/1977 | Hamling et al. . | |
| 4,175,117 | 11/1979 | Hill | 241/27 X |
| 4,332,354 | 6/1982 | Demonterey et al. . | |
| 4,624,418 | 11/1986 | Szkaradev . | |
| 4,627,959 | 12/1986 | Gilman et al. . | |
| 4,647,304 | 3/1987 | Petkovic-Luton et al. . | |
| 4,651,935 | 3/1987 | Samosky et al. . | |
| 4,676,439 | 6/1987 | Saito et al. . | |
| 4,787,561 | 11/1988 | Kemp, Jr. et al. . | |
| 4,844,355 | 7/1989 | Kemp, Jr. et al. . | |
| 4,913,361 | 4/1990 | Reynolds . | |
| 4,966,331 | 10/1990 | Maier et al. . | |
| 5,033,682 | 7/1991 | Braun . | |
| 5,065,946 | 11/1991 | Nishida et al. . | |
| 5,083,712 | 1/1992 | Askew et al. . | |
| 5,112,388 | 5/1992 | Schulz et al. . | |
| 5,147,449 | 9/1992 | Grewe et al. . | |
| 5,270,076 | 12/1993 | Evers . | |
| 5,320,284 | 6/1994 | Nishida et al. | 241/21 |
| 5,338,712 | 8/1994 | MacMillan et al. . | |
| 5,350,437 | 9/1994 | Watanabe et al. . | |

FOREIGN PATENT DOCUMENTS

| | | |
|---|---|---|
| 55-104658 | 8/1980 | Japan . |
| 1507443 | 9/1989 | Russian Federation . |

OTHER PUBLICATIONS

Painting & Coatings Industry, Jul. 1994 "Premilling Canoptimize Your Dispersion Process".

*Primary Examiner*—John M. Husar
*Attorney, Agent, or Firm*—Paul and Paul

[57] ABSTRACT

In a process for rapidly producing colloidal particles a feedstock of particles less than a micron in size is provided to a stirred media mill, along with ceramic beads less than 100 microns in size. The mill is filled to a volume in excess of 90%, and operated at tip speeds in excess of 20 meters/second with a residence time less than about two minutes; thereby producing particles having an average particle size less than about 0.1 micron from the feedstock.

5 Claims, No Drawings

PROCESS FOR RAPID PRODUCTION OF COLLOIDAL PARTICLES

CROSS-REFERENCE TO RELATED APPLICATION

This application is a continuation-in-part of U.S. patent application Ser. No. 08/482,077, filed Jun. 7, 1995 now abandoned.

BACKGROUND OF THE INVENTION

1. Field of the Invention

The present invention concerns a process to rapidly produce finely divided particles by media grinding techniques.

2. Background of the Invention

Colloidal particles (that is, particles less than 100 nanometers or 0.1 micron in size) of commercial interest are typically prepared by thermo-chemical and phase change techniques, such by particle growth from solution or gas phase chemical reaction. Examples of such processes include flame decomposition of atomized salt solutions, hydrolysis or pyrolysis of organo-metallic compounds such as alkoxides, sol-gel processes, and plasma arc processes. Each such process involves a phase change and frequently a chemical reaction as well. Many of these process are expensive and pose special environmental problems. Conversely, it is commonly believed that particles this small simply cannot be produced from larger particles by mechanical means, such as by grinding techniques, without inordinate and costly power consumption.

Mechanical techniques for particle size reduction have been known since ancient times. One mechanical technique for particle size reduction employs agitating a feed stock together with a media of harder particles, such that the media and the feedstock particles collide, and the feedstock particles are broken in these collisions.

However, in classical grinding theory, there is a power law relationship between an infinitesimal increment in energy expended for bring about an infinitesimal increase in the overell fineness of the particle:

$$dE = -K \times \frac{dX}{X^n}$$

where E is the net energy input to the mill, X is a single paramater measure of the particle fineness (i.e. a characteristic length of the particle length), and K is a proportionality constant depending on the "grindability" of the material and the efficiency of the mill. "n" is not invariant, but depends on the particle size regime. P. C. Kapur, "Fine Grinding," ADVANCES IN COMMINUTION: FINE GRINDING (Thomas Meloy, editor), papers presented at POWDEX, 1995 (Philadelphia, Pa.). In the subsieve range (less than 400 mesh or 32 micron), n increases rapidly, and may tend towards infinity as fineness increases. There is therefore a rapid increase in energy consumption with decreasing particle size in the fine particle region (less than 100 microns) according to classical theory, and heretofore empirical observations have supported this view. The result is an empirically observed "grinding limit" beyond which particle size no longer decreases with increasing input energy, with the additional energy input resulting simply in friction between the particles, plastic particle deformation, and aggregation and simultaneous rebreakage of the aggregated particles. When high levels of energy are employed, there is an additional concern that degradation of mill surfaces and media will tend to substantially increase the contamination of the feed stock with foreign matter.

One conventional example of a medium for mechanical particle size reduction is sand. Sand mills were developed in 1947 by E. I. Du Pont to deagglomerate pigments. This process has evolved over the years into the attrition mill developed by Union Process Company and the horizontal media mill developed by Netzsch, Premier, Eiger, Buehler, Zussmeir, Chicago Boiler, Ross Machinery, Draiswerkes and Wiky Bachoften AG Machinefabdk.

Both types of mills are designed primarily for paint, ink, and pigment manufacturers who want to deagglomerate pigments to 0.2 micron particle size to maximize opacity.

Various prior art process exist wherein a horizontal bead mill is operated with 0.25 mm media and impeller speeds of up to 20 meters/sec (4000 feet/min.) to produce particles as small as 0.10 micron. See Table A below.

TABLE A

| Assignee | Matsumitsu Nishida | BASF | Sterling Drug |
|---|---|---|---|
| U.S. Pat. No. | 5,065,946 | 4,332,254 | 5,145,684 |
| Horizontal Media Mill | Dyno M-50 | Dyno DK-5 | Dyno DK-5 |
| Particle Size | 0.11 micron | <0.10 micron | 0.14 micron |
| Bead Type | Zirconia | Glass | Glass |
| Bead Size | 0.30 mm | 0.25 mm | 0.50 mm |
| Maximum Impeller Speed | 20 meter/sec | 20 meters/sec | |

Despite the progress which has been made in providing product having a small particle size using agitated media mills, to date it has not been possible to use media mills to provide products having colloidal size particles, this is, with a particle size less than about 0.1 microns in a commercially acceptable period of time. Further, it is conventionally understood that it is not practical to use grinding techniques to achieve such particle sizes, as they are believed to (1) require excessive amounts of energy and entail increasing amounts of contamination, and/or (2) approach or exceed the "grinding limit" beyond which it is simply not possible to further reduce the average particle size.

SUMMARY OF THE INVENTION

In view of the above deficiencies in the prior art it is an object of this invention to produce particles of both inorganic and organic materials that are less than 0.10 micron by grinding/attriting larger particles in a media mill, such as a horizontal or vertical media mill.

Unexpectedly, it has now been found that colloidal size particles can be produced using milling techniques from larger particles, in a very short period of time, with concomitantly low energy consumption, contradicting the conventional understanding of the mechanics of fine particle grinding.

The present invention provides a process for rapidly producing colloidal particles, the process comprises (a) providing a feedstock slurry having an average particle size less than one micron to a stirred media mill, the slurry including from about 5 to 10 percent by weight dispersant; and a total solids of less than about 50 percent by weight in a low viscosity fluid;

(b) providing ceramic beads less than 100 microns in diameter in the mill;

(c) filling the mill to a volume in excess of 90%;

(d) operating the mill at tip speeds at least 20 meters/sec; and (e) limiting the residence time to less than about 30 minutes. Preferably, the residence time is limited to less than about two minutes. This will produce particles having an average particle size less than about 0.1 micron from the feedstock. Preferably the size of the diameter of the ceramic beads is no more than about one hundred times the average particle size of the feedstock particles. Preferably, the energy consumption of the mill is maintained below 200 kilowatt-hours per ton of feedstock, and more preferably less than about 100 kilowatt-hours per ton of feedstock.

DETAILED DESCRIPTION OF THE PREFERRED EMBODIMENTS

The particle size of the product of the present process is determined by several processing variables. In addition, the mill type can determine how quickly a particular result can be achieved.

Other factors which affect the ultimate size of the ground material, as well as the time and energy it takes to achieve them include the following:

(1) In wet media milling, smaller media are more efficient in producing finer particles within short milling times of 30 minutes or less.

(2) More dense media and higher tip speeds are desired to impart more energy to the particles being ground, and thereby shorten the time in the mill.

(3) As the particles are reduced in diameter, exposed surface areas increase, and a dispersing agent is generally used to keep small particles from agglomerating. In some cases dilution alone can help achieve a particular ultimate particle size, but a dispersing agent is generally used to achieve long-term stability against agglomeration.

The above and other factors that influence grinding performance are discussed in the paragraphs that follow.

As used herein "particle size" refers to a volumetric average particle size as measured by conventional particle size measuring techniques such as sedimentation, photon correlation spectroscopy, field flow fractionation, disk centrifugation, transmission electron microscopy, and dynamic light scattering. A dynamic light scattering device such as a Horiba LA-900 Laser Scattering particle size analyzer (Horiba Instruments of Japan) is preferred by the present inventors, because it has advantages of easy sample preparation and speed. The volumetric distribution of the sample relates to the weight through density. A numerical average gives a lower average.

Milling Equipment

The milling equipment preferred for the practice of the invention are generally known as a wet agitated media mills, wherein grinding media are agitated in a closed milling chamber. The preferred method of agitation is by means of an agitator comprising a rotating shaft, such as those found in attritor mills (agitated ball mills). The shaft may be provided with disks, arms, pins, or other attachments. The portion of the attachment that is radially the most remote from the shaft is referred to herein as the "tip". The mills may be operated in a batch or continuous mode, in a vertical or horizontal position.

In a horizontal media mill, the effects of gravity on the media are negligible, and higher loadings of media are possible (e.g., loadings of up to about 92% of chamber volume); however, vertical media mills can also be employed.

A horizontal or vertical continuous media mill equipped with an internal screen having openings that are ½ to ⅓ the media diameter is preferred.

Conventional fine particle screens for media mill typically employ a plurality of parallel wires having a triangular cross-section ("wedge wire"), with a fixed, small, distance separating the wires at their bases. This inter-wire distance must be smaller than the particle size of the media in order to retain the media in the mill but greater than the average particle size of the product. The smallest inter-wire distance for available in wedge wire screens is 0.015 mm±50 percent, or 0.025 min. At this opening size there is only 1.7 percent open area in the wedge wire screen causing excessive back pressure and shutdown of the mills. To overcome this problem when using small media, e.g. 25 micron, a composite screen was fabricated. This screen is made by covering a wedge wire screen having 0.500 mm inter wire distance and 32 percent opening with cloth made from stainless steel wires and having 0.20 mm rectangular openings. The composite screen has 8 percent open area and allows the mill to be operated continuously.

An increase in the amount of grinding media in the chamber will increase grinding efficiency by decreasing the distances between individual particles and increasing the number of surfaces available to shear the material to be comminuted. The amount of grinding media can be increased until the grinding media constitutes up to about 92% of the mill chamber volume. At levels substantially above this point, the media does not flow.

Preferably, the media mill is operated in a continuous mode in which the product is recirculated to the input to the mill. Recirculation of the product can be driven by conventional means, such as by employing a peristaltic pump. Preferably, the product is recirculated as quickly as possible to achieve a short residence time in the mill chamber. Preferably, the residence time in the mill chamber is less than about two minutes.

Starting Materials

By the present invention, inorganic solids can be wet milled to particle size levels that are currently not achievable with dry milling techniques.

The size of the feed material that is to be ground is critical to the process of the present invention. For example, while sodium aluminosilicate can be reduced to a 0.20 micron average particle size with commercially available equipment, starting from particles that have an average particle size of 4.5 microns, these larger feed particles require more passes than would be required if the average initial particle size of the feedstock were, for example, less than one micron.

Also it should be noted that the average particle size of the feedstock does not decrease linearly with the number of passes. In fact, it rapidly approaches an asymptote which is presently believed to relate to the "free volume" of the grinding media (i.e. the average interstitial volume).

Media milling can actually grind down particles, rather than merely deagglomerating clumps of pre-sized particles. As a result, faster milling times can be achieved, if smaller starting materials are used. Thus, it is preferable to start with particles that are as small as is economically feasible, to reduce milling time.

Grinding Media

Acceptable grinding media for the practice of the present invention include sand, glass beads, metal beads, and ceramic beads. Preferred glass beads include barium titanate (leaded), soda lime (unleaded), and borosilicate. Preferred metals include carbon steel, stainless steel and tungsten carbide. Preferred ceramics include yttrium toughened zirconium oxide, zirconium silicate, and alumina. The most preferred grinding media for the purpose of the invention is yttrium toughened zirconium oxide.

Each type of media has its own advantages. For example, metals have the highest specific gravitites, which increase grinding efficiency due to increased impact energy. Metal costs range from low to high, but metal contamination of final product can be an issue. Glasses are advantageous from the standpoint of low cost and the availability of small bead sizes as low as 0.004 mm. Such small sizes make possible a finer ultimate particle size. The specific gravity of glasses, however, is lower than other media and significantly more milling time is required. Finally, ceramics are advantageous from the standpoint of low wear and contamination, ease of cleaning, and high hardness.

The grinding media used for particle size reduction are preferably spherical. As noted previously, smaller grinding media sizes result in smaller ultimate particle sizes. The grinding media for the practice of the present invention preferably have an average size ranging from about 4 to 1000 microns (0.004 to 1.0 mm), more preferably from about 25 to 150 microns (0.025 to 0.15 mm).

Fluid Vehicles

Fluid vehicles in which the particles may be ground and dispersed include water and organic solvents. In general, as long as the fluid vehicle used has a reasonably low viscosity and does not adversely affect the chemical or physical characteristics of the particles, the choice of fluid vehicle is optional. Water is ordinarily preferred.

Wetting Agents/Dispersing Agents

Wetting agents act to reduce the surface tension of the fluid to wet newly exposed surfaces that result when particles are broken open. Preferred wetting agents for performing this function are non-ionic surfactants such as those listed below.

Dispersing agents preferably stabilize the resulting slurry of milled particles by providing either (1) a positive or negative electric charge on the milled particles or (2) steric blocking through the use of a large bulking molecule. An electric charge is preferably introduced by means of anionic and cationic surfactants, while steric blocking is preferably performed by adsorbed polymers with charges which repel each other. Zwitterionic surfactants can have both anionic and cationic surfactant characteristics on the same molecule.

Preferred surfactants for the practice of the invention include non-ionic wetting agents (such as Triton™ X-100 and Triton CF-10, sold by Union Carbide, Tarrytown, N.Y.; and Neodol™ 91-6, sold by Shell Chemical, Houston, Tex.); anionic surfactants (such as Tamol™ 731, Tamol 931 and Tamol SN, sold by Rohm and Haas, Philadelphia, Pa., and Colloid™ 226/35, sold by Rhone Poulenc); cationic surfactants (such as Disperbyke™ 182 sold by Byke Chemie, Wallingford, Conn.); amphoteric surfactants (such as Crosultain™ T-30 and Incrosoft™ T-90, sold by Croda; and non-ionic surfactants (such as Disperse-Ayd™ W-22 sold by Daniel Products Co., Jersey City, N.J. Most preferred dispersion agents are anionic surfactants such as Tamol SN.

Other Milling Parameters

The relative proportions of particles to be ground, fluid vehicles, grinding media and dispersion agents may be optimized for the practice of the present invention.

Preferably, the final slurry exiting the mill comprises the following: (1) 5 to 50 wt %, more preferably 15 to 45 wt %, of the material to be ground; (2) 50 to 95 wt %, more preferably 55 to 85 wt %, of the fluid vehicle; and (3) 2 to 15 wt %, more preferably 6 to 10 wt %, of the dispersion agent.

Preferably the grinding media loading measured as a volume percent of the mill chamber volume is 80 to 95%, more preferably 90 to 93%.

The agitator speed controls the amount of energy that is put into the mill. The higher the agitator speed, the more kinetic energy is put into the mill. Higher kinetic energy results in greater grinding efficiency, due to higher shear and impact. Thus, an increase in agitator rotational speed results in an increase in grinding efficiency. Although generally desirable, it is understood by those skilled in the art that an increase in grinding efficiency will be accompanied by a concurrent increase in chamber temperature, chamber pressure, and wear rate.

The tip speed of the agitator represents the maximum velocity (and, thus, kinetic energy) experienced by the particles to be milled. Thus, larger diameter mills can impart higher media velocities than smaller mills when operating at the same rotational speed.

Residence time (also referred to herein as retention time) is the amount of time that the material spends in the grinding chamber while being exposed to the grinding media. Residence time is calculated by simply determining the grinding volume that is available for the mill and dividing this figure by the rate of flow through the mill (throughput rate), as determined by the operating characteristics of the recirculation pump.

In general, a certain residence time will be required to achieve the ultimate product characteristics desired (e.g., final product size). If this residence time can be reduced, a higher throughput rate can be achieved, minimizing capital costs. For the practice of the present invention, the residence time can vary, but is preferably less than 30 minutes, and more preferably less than two minutes.

It is often desirable to stage two or more mills in series, particularly when dramatic reductions in particle size are necessary, or when narrow particle size distributions are necessary. In general, size reduction of particles within a given milling step can range from about 10:1 to as high as about 40:1. As a result, the number of milling steps increases as the overall size reduction requirement increases. For example, assuming that one wishes to reduce material having a nominal diameter of 100 microns to an ultimate particle size of 0.1 microns, then three mills in series would preferably be used. Similar effects can also be achieved using a single mill by collecting the output and repeatedly feeding the output through the mill.

EXAMPLES

The following examples, as well as the foregoing description of the invention and its various embodiments, are not intended to be limiting of the invention but rather are illustrative thereof. Those skilled in the art can formulate further embodiments encompassed within the scope of the present invention.

Example 1

A 10 liter horizontal continuous media mill (Netzsch, Inc., Exton, Pa.) was 90% filed with YTZ (yttrium toughened zirconium oxide) media with an average diameter of 0.2 mm and a specific gravity of 5.95 (Tosoh Corp., Bound Brook, N.J.). A 0.1 mm screen was installed inside the mill at the outlet.

Forty-five pounds of antimony trioxide with an average starting particle size of 2.0 microns (Cookston Specialty Additives, Anzon Division, Philadelphia, Pa.) were slurried in 55 pounds of water containing 4.5 pounds of Tamol-SN.

The mill was operated at a tip speed that averaged 2856 feet per minute. After 7.5 minutes of retention time (5 passes through the mill) the average particle size, by volume, was reduced to 0.102 micron and 99.9% of the particles had sizes less than 0.345 micron.

Example 2

The same mill, media and loading as in Example 1 were used. This time, antimony trioxide feed having a 0.6 micron average particle size (Cookson Specialty Additives, Anzon Division, Philadelphia, Pa.) was used. Thirty pounds of the submicron antimony trioxide were slurried with 70 pounds of water containing 1.8 pounds of TamoI-SN and 0.9 pounds of Triton CF-10.

The tip speed during the run averaged 2878 feet per minute. After 4.8 minutes of retention time in the mill (4 passes), the volume average particle size was 0.11 micron and 99.9% of the particles had sizes less than 0.31 micron.

Example 3

The same mill, media, antimony trioxide and loading as in Example 1 were used. This time no surfactants were used.

Twenty-eight pounds of the antimony trioxide were slurried with 100 pounds of water. Tip speed was 3023 feet per minute. After 2.4 minutes of retention time (2 passes), the average particle was 0.13 micron with 99.9% of the particles having sizes less than 1.06 micron.

Since the viscosity of the product was high, 35 additional pounds of water were added. After 1.8 minutes of additional retention time (2 extra passes), the average particle size was further reduced to 0.10 micron, with 99.9% of the particles having sizes less than 0.32 micron.

Example 4

The same mill, media, and loading as in Example 1 were used. Thirty pounds of coarse 4 micron antimony trioxide feed material (Cookson Specialty Additives, Anzon Division) were slurried with 70 pounds of water containing 2.8 pounds of Tamol-SN. Tip speed was 2860 feet per minute. After 7 minutes of retention time (5 passes), the average particle size was 0.10 micron with 99.9% of the particles having sizes less than 1.2 micron.

Example 5

An attritor (Union Process, Inc., Akron, Ohio) with a 750 cc tank volume was loaded with 250 cc of YTZ powder (Metco, Inc., Westbury, N.Y.) screened to a size of 0.053 mm. A slurry was formed form 55 g antimony trioxide solids with an average particle size of 0.10 microns (made by the process of Example 1), 55 g water and 4.5 g Tamol-SN, and 185 of this slurry was added to the attritor. After running the attritor at 4000 RPM (3600 ft/min.) for 60 minutes, the average particle size was reduced to 0.07 microns.

The results of these runs (see FIG. 1) indicate that with smaller ceramic beads, for example, 0.150 mm and 0.053 mm, the fourth pass particle size will reach 0.070 microns and 0.015 micron respectively. At this point no horizontal media mill is designed for beads under 0.2 mm.

Example 6

A vertical media mill, Drais Perl mill, Type DCP-L Eirich Draiswerkes, (Gurnee Ill.), with a 1.2 liter chamber and a 5 hp electric motor, was employed. The standard wedge wire screen was over-wrapped with a 635 mesh wire cloth to retain the very small yttrium toughened zirconium oxide beads employed as a media. The yttrium toughened zirconium oxide beads were supplied by Nikkato Corp. of Osaka, Japan, and had nominal average particle sizes of 135 microns. Because the vertical mill has rotor seals located above the upper fill level of the chamber, very small media, which might otherwise penetrate the rotor seals, can be employed. The mill, powered by the electric motor drawing 7 amps of current at 220 volts, was operated in a recirculation mode using a peristaltic pump to circulate the feedstock slurry. The feed tank held 10.65 liters of 20 percent by weight zeolite A suspended in water using 8 percent by weight Tamol SN anionic dispersant to assure that no undue thickening or agglomeration would occur as the mill reduced the particle size to very low levels with high surface area. A recirculation rate of 4.4 liters per minute was employed. The milling chamber was filled to the 90 percent level, and a tip speed of 14.8 meters/second was employed. Samples were taken periodically as shown in Table B below and the particle size was measured using a Hodba LA-900 photon correlation particle size analyzer, which has a lower limit of detection of about 0.1 micron.

TABLE B

| Elapsed Time (minutes) | Mill Residence Time (minutes) | Particle Size (microns) |
|---|---|---|
| 0 | 0.86 | 2.12 |
| 15 | 1.62 | 0.26 |
| 30 | 2.42 | 0.216 |
| 45 | 3.42 | 0.184 |
| 60 | 3.24 | 0.151 |
| 75 | 4.05 | 0.075 |

The data in Table B show that for 20 pounds of feedstock a particle size reduction about 2 microns to under one micron was achieved in about one and a quarter hours using about 1.5 kilowatt, giving a calculated energy consumption rate of less than about 200 kilowatt-hours per ton of feedstock.

Example 7

The process of Example 6 was repeated, except that the a tip speed of 16.8 meters/second was employed, the recirculation rate was 0.6 liters per minute was used; the media was 60 micron yttrium toughened zirconium oxide from the same source, and the product of Example 6 was used as the feed stock.

Samples were taken periodically as shown in Table C below and the particle size was initially measured using a Horiba LA-900 photon correlation particle size analyzer. However, all samples showed a particle size of 0.076 micron using this technique, suggesting that this was the lower limit of detection for this instrument. Subsequently, particle sizes for the samples were determined by transmission electron microscopy, revealed (for the 30 minute sample) a smaller mean particle size of 0.042 micron, with the largest particles being no more than about 0.1 micron.

TABLE C

| Elapsed Time (minutes) | Mill Residence Time (minutes) | Particle Size (microns) |
|---|---|---|
| 0 | 0 | 0.075 |
| 15 | 0.86 | 0.059 |
| 30 | 1.62 | 0.042 |

The data in Table C show that the size reduction was realized in less than two minutes of residence time in the mill or less than 30 minutes of operation, requiring less than about one kilowatt-hour of power consumption for the 20 pounds of feedstock, giving a calculated power consumption of less than about 100 kilowatt-hours per ton of feedstock.

Various modifications can be made in the details of the various embodiments of the processes and compositions of the present invention, all within the scope and spirit of the invention and defined by the appended claims.

I claim:

1. A process for rapidly producing colloidal particles, the process comprising (a) providing a feedstock slurry having an average particle size less than one micron to a stirred media mill, the slurry including from about 5 to 10 percent by weight dispersant; and a total solids of less than about 50 percent by weight in a low viscosity fluid;

(b) providing ceramic beads less than 100 microns in diameter in the mill;

(c) filling the mill to a volume in excess of 90%;

(d) operating the mill at tip speeds at least 20 meters/sec; and (e) limiting the residence time to less than about two minutes;.

thereby producing particles having an average particle size less than about 0.1 micron from the feedstock.

2. A process according to claim 1 wherein the ceramic beads are selected from zircon, glass and yttrium toughened zirconium oxide.

3. A process according to claim 1 wherein the size of the diameter of the ceramic beads is no more than about one hundred times the average particle size of the feedstock particles.

4. A process according to claim 1 wherein the energy consumed by the mill is less than about 100 kilowatt-hour per ton of feedstock.

5. A process for rapidly producing colloidal particles, the process comprising (a) providing a feedstock slurry having an average particle size less than one micron to a stirred media mill, the slurry including from about 5 to 10 percent by weight dispersant; and a total solids of less than about 50 percent by weight in a low viscosity fluid;

(b) providing yttrium toughened zirconium oxide ceramic beads less than 100 microns in diameter in the mill;

(c) filling the mill to a volume in excess of 90%;

(d) operating the mill at tip speeds at least 20 meters/sec;

(e) limiting the residence time to less than about two minutes; and (f) providing less than about 100 kilowatt-hour of energy to drive the mill per ton of feedstock;

thereby producing particles having an average particle size less than about 0.1 micron from the feedstock.

* * * * *